US006214784B1

(12) United States Patent
Robbins et al.

(10) Patent No.: US 6,214,784 B1
(45) **Date of Patent: *Apr. 10, 2001**

(54) LOW ODOR, HARD SURFACE CLEANER WITH ENHANCED SOIL REMOVAL

(75) Inventors: Michael H. Robbins, Walnut Creek; Jennifer C. Julian, Castro Valley, both of CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/427,156

(22) Filed: Oct. 25, 1999

Related U.S. Application Data

(62) Division of application No. 08/731,653, filed on Oct. 17, 1996, now Pat. No. 5,972,876.

(51) Int. Cl.[7] ..... C11D 1/75; C11D 1/72; C11D 1/86; C11D 3/43

(52) U.S. Cl. ..... 510/423; 510/191; 510/238; 510/421; 510/422; 510/423; 510/427; 510/433; 510/434; 510/499; 510/503; 510/504

(58) Field of Search ..... 510/191, 238, 510/421, 422, 423, 427, 433, 434, 499, 503, 504, 424; 134/42

(56) References Cited

U.S. PATENT DOCUMENTS

| | | | |
|---|---|---|---|
| H269 | 5/1987 | Malik | 422/37 |
| 4,029,607 | 6/1977 | Murtaugh | 252/545 |
| 4,158,644 | 6/1979 | Hamerel | 252/547 |
| 4,207,215 | 6/1980 | Bolan | 252/542 |
| 4,530,781 | 7/1985 | Gipp | 252/546 |
| 4,595,527 | 6/1986 | Gipp | 252/546 |
| 4,637,899 | 1/1987 | Kennedy, Jr. | 252/542 |
| 4,687,592 | 8/1987 | Collins | 252/99 |
| 4,734,259 | 3/1988 | Frenier | 422/16 |
| 4,749,516 | 6/1988 | Brusky | 252/546 |
| 4,844,744 | 7/1989 | Leiter | 134/40 |
| 5,013,483 | 5/1991 | Frenier | 252/396 |

(List continued on next page.)

FOREIGN PATENT DOCUMENTS

| | | | |
|---|---|---|---|
| 2-180999 | 7/1990 | (JP) | C11D/3/33 |

OTHER PUBLICATIONS

FWC (filed Feb. 27, 1997) of previously filed U.S. Patent Application Ser. No. 08/507,543, Jul. 26, 1995, "Antimicrobial Hard Surface Cleaner," Zhou et al.

U.S. Patent Application Ser. No. 08/605,822, Feb. 23, 1996, "Composition and Apparatus for Surface Cleaning," Choy et al.

U.S. Patent Application Ser. No. 08/632,041, Apr. 12, 1996, "Hard Surface Cleaner with Enhanced Soil Removal," Mills et al.

*Primary Examiner*—Gregory R. Del Cotto
(74) *Attorney, Agent, or Firm*—Joel J. Hayashida

(57) ABSTRACT

An aqueous hard surface cleaner with improved soil removal is provided and has, as components, the following:

(a) either an anionic, nonionic, amphoteric surfactant, and mixtures thereof with optionally, a quaternary ammonium surfactant, the total amount of the surfactants being present in a cleaning effective amount;

(b) at least one water-soluble or dispersible organic solvent having a vapor pressure of at least 0.001 mm Hg at 25° C., present in a solubilizing—or dispersion—effective amount;

(c) Tetrapotassium ethylenediamine—tetraacetate (potassium EDTA) as a chelating agent, present in an amount effective to enhance soil removal in said cleaner; and (d) the remainder, water.

16 Claims, 5 Drawing Sheets

U.S. PATENT DOCUMENTS

| | | | |
|---|---|---|---|
| 5,062,987 | 11/1991 | Turcotte | 252/156 |
| 5,071,582 | 12/1991 | Conville | 252/81 |
| 5,252,245 | 10/1993 | Garabedian, Jr. | 252/153 |
| 5,266,121 | 11/1993 | Cioletti | 134/3 |
| 5,328,561 | 7/1994 | Letize | 156/666 |
| 5,417,887 | 5/1995 | Skeele | 252/309 |
| 5,437,807 | 8/1995 | Garabedian, Jr. | 252/153 |
| 5,454,984 | 10/1995 | Graubart | 252/547 |
| 5,468,423 | 11/1995 | Garabedian, Jr. | 252/546 |
| 5,476,615 | 12/1995 | Hall | 252/547 |
| 5,585,342 | 12/1996 | Choy et al. | 510/433 |
| 5,767,055 * | 6/1998 | Choy et al. | 510/406 |
| 5,814,591 | 9/1998 | Mills et al. | 510/238 |
| 5,948,741 | 9/1999 | Ochomogo et al. | 510/191 |
| 5,948,742 | 9/1999 | Chang et al. | 510/191 |
| 5,972,876 * | 10/1999 | Robbins et al. | 510/423 |
| 6,013,615 * | 1/2000 | Zhou et al. | 510/434 |

* cited by examiner

Potassium EDTA Cleaning Performance
ON BATHROOM SOIL
Soil Removal (%)
100
80
60
40
20
0
0
10
20
30
Cycles
Eg. II
■5.4% K4 EDTA
0% Na4EDTA
Eg. III
◆4.4% K4 EDTA
1.0% Na4EDTA
Eg. IV
▲3.4% K4 EDTA
2.0% Na4EDTA
Eg. V
●2.4% K4 EDTA
3.0% Na4EDTA
Eg. VI
○1.4% K4 EDTA
4.0% Na4EDTA
Eg. VII
▼0% K4 EDTA
5.4% Na4EDTA Tile SSR Performance Study-Drop Test
Visual Grade
12
10
8
6
4
2
0
10 10 10 10 10 10
1
10 10 10 10 10 10
1
10 10 10 10 9 10
1
30 sec
60 sec
90 sec
XIII 2.5% K4EDTA
XIV 3.0% K4EDTA
XV 3.5% K4EDTA
XVI 4% K4EDTA
XVII 4.25% K4EDTA
XVIII 5.4% K4EDTA
COMP.

LOW ODOR, HARD SURFACE CLEANER WITH ENHANCED SOIL REMOVAL

This is a division, of a application Ser. No. 08/731,653, filed Oct. 17, 1996, now U.S. Pat. No. 5,972,876 entitled "LOW ODOR, HARD SURFACE CLEANER WITH IMPROVED SOIL REMOVAL"

BACKGROUND OF THE INVENTION

1. Field of the Invention

The invention relates to a hard surface cleaner especially effective on bathroom soils, such as soap scum.

2. Brief Statement of the Related Art

A number of hard surface cleaners have been specially formulated to target bathroom soils. These include products containing liquid hypochlorite for combating mildew and fungus; products with quaternary ammonium compounds as bacteriostats; and acidic cleaners, such as those containing phosphoric or other strong mineral acids.

These cleaners will typically include buffers, dyes, fragrances, and the like in order to provide performance and/or aesthetic enhancements.

Graubart et al., U.S. Pat. No. 5,454,984, discloses a cleaning composition comprising quaternary ammonium compounds, tetrasodium EDTA, a mixture of surfactants, and a glycol ether. However, the reference fails to teach, disclose or suggest the use of potassium EDTA as a chelating agent.

Garabedian et al., U.S. Pat. Nos. 5,252,245, 5,437,807 and 5,468,423, and Choy et al., U.S. patent application Ser. No. 08/410,470, filed Mar.24, 1995, all of common assignment herewith, disclose improved glass and surface cleaners which combine either amphoteric or nonionic surfactants with solvents and effective buffers to provide excellent streaking/filming characteristics on glass and other smooth, glossy surfaces. These disclosures are incorporated herein by reference thereto.

Co-pending application Ser. No. 08/507,543, filed Jul. 26, 1995, now U.S. Pat. No. 6,013,615 of Zhou et al., entitled "Antimicrobial Hard Surface Cleaner," of common assignment, discloses and claims an antimicrobial hard surface cleaner which includes amine oxide, quaternary ammonium compound and tetrasodium EDTA, in which a critical amine oxide: EDTA ratio results in enhanced non-streaking and non-filming performance.

Co-pending application Ser. No. 08/605,822, filed Feb. 23, 1996, now U.S. Pat. No. 5,767,055 of Choy et al., entitled "Composition and Apparatus for Surface Cleaning," of common assignment, discloses and claims a hard surface cleaner which uses a dual chamber delivery system, one chamber containing an oxidant solution and the other, a combination of chelating agents and surfactants.

Co-pending application Ser. No. 08/632,041, filed Apr. 12, 1996, now U.S. Pat. No. 5,814,591 of Mills et al., entitled "Hard Surface Cleaner with Enhanced Soil Removal," of common assignment, discloses and claims a hard surface cleaner which includes surfactants and tetraammonium EDTA for proficient soap scum and soil removal.

However, none of the art discloses, teaches or suggest the use of tetrapotassium EDTA as an effective chelating agent which additionally surprisingly enhances the soil removing, especially soap scum-removing, ability of the liquid, one phase cleaners formulated therewith. Additionally, unlike some of the prior chelating agents, tetrapotassium EDTA has very low to no odor, which is a significant beneficial attribute to the inventive cleaners hereof. Moreover, none of the art discloses, teaches or suggests the unexpected speed at which the inventive cleaners work.

SUMMARY OF THE INVENTION AND OBJECTS

The invention provides an aqueous, hard surface cleaner, said cleaner comprising:

an aqueous hard surface cleaner with improved soil, especially soap scum, removal comprising:

(a) either an anionic, nonionic, amphoteric surfactant, and mixtures thereof with optionally, a quaternary ammonium surfactant, said surfactants being present in a cleaning—effective amount;

(b) at least one water-soluble or dispersible organic solvent having a vapor pressure of at least 0.001 mm Hg at 25° C., said at least one organic solvent present in a solubilizing—or dispersion—effective amount;

(c) Tetrapotassium ethylenediamine—tetraacetate (potassium EDTA) as a chelating agent, said potassium EDTA present in an amount effective to enhance soil removal in said cleaner; and (d) the remainder, water.

The invention further comprises a method of cleaning soils, especially soap scum from hard surfaces by applying said inventive cleaner to said soap scum, and removing both from said surface.

It is therefore an object of this invention to improve soil, especially soap seum, removal from hard surfaces.

It is another object of this invention to markedly increase the speed in which such soils, especially soap scum, are removed from the hard surface cleaned.

It is also an object of this invention to provide a hard surface cleaner for bathroom soils, which include oily and particulate soils.

It is a further object of this invention to provide a low to no odor hard surface cleaner.

DETAILED DESCRIPTION OF THE INVENTION

Figure 1:
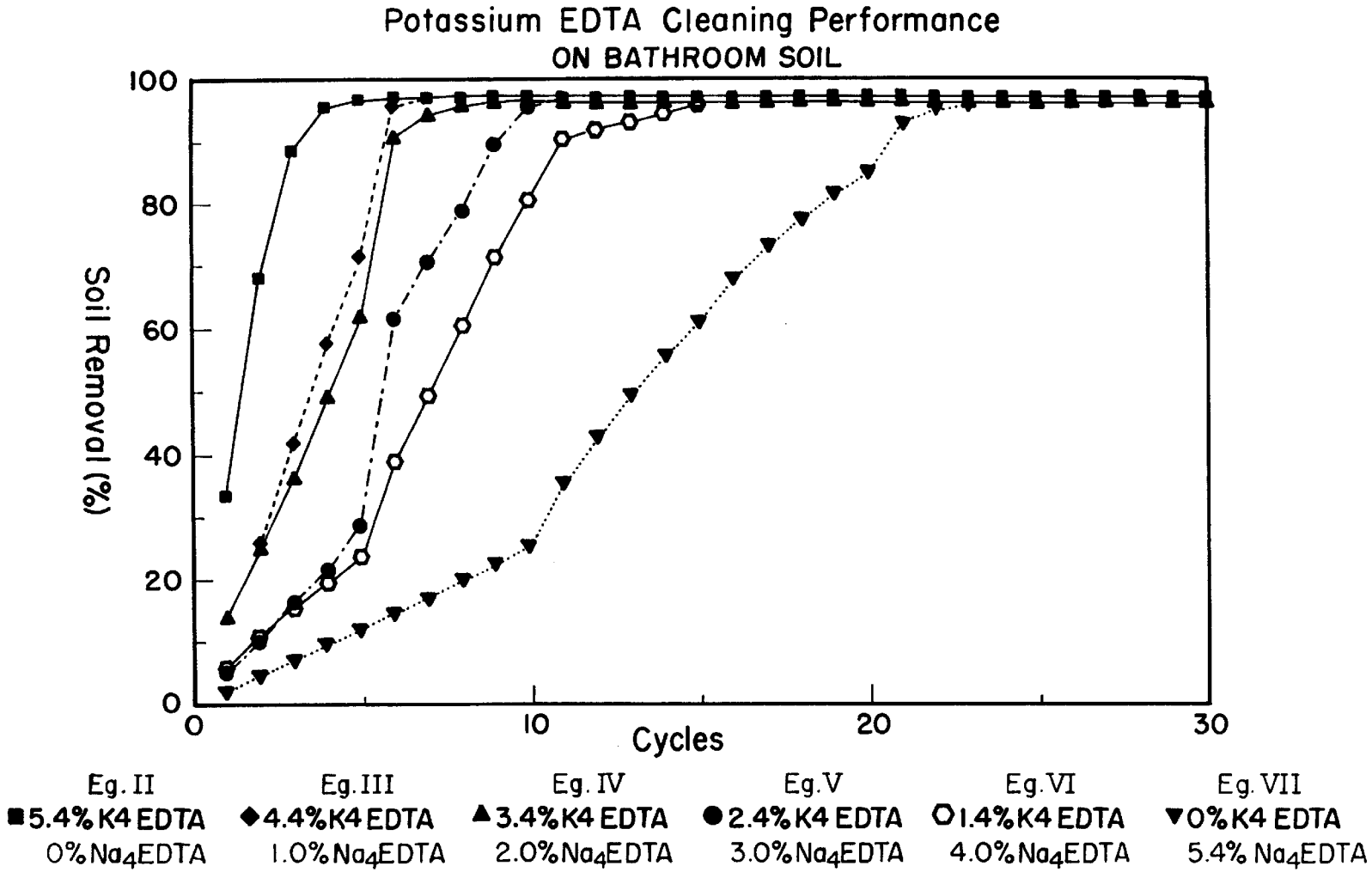
FIGS. 1–5 are graphical depictions of the soil removing performances of the inventive cleaner.

The invention provides an improved, all purpose cleaner especially adapted for the complete and speedy removal of soap scum and other bathroom soils from a hard surface. These types of cleaners are intended to clean hard surfaces by application of a metered discrete amount of the cleaner, typically by pump or trigger sprayer onto the surface to be cleaned or onto the workpiece—such as a soft cloth, mop or sponge—and then wiping the surface, thus removing the soil and the cleaner, with or without the need for rinsing with water. In the case of a concentrate, the concentrate is first diluted with water, or water/solvent mixture, then the diluted mixture is applied by workpiece or by simply pouring onto the surface to be cleaned. The typical bathroom surface is a shower stall, both the glass doors, as well as the vertical wall surfaces (typically made of tile, or composite materials), sinks and glass. The cleaner is preferably a single phase, clear, isotropic solution, having a viscosity generally less than about 100 Centipoise ("cps") (unless as a concentrate, in which case, below about 100,000 cps). The cleaner itself has the following ingredients:

(a) an anionic, nonionic or amphoteric surfactant, and mixtures thereof with optionally, a quaternary ammonium surfactant, said surfactants being present in a cleaning—effective amount;

(b) at least one water-soluble or dispersible organic solvent having a vapor,pressure of at least 0.001 mm Hg at 25° C., said at least one organic solvent present in a solubilizing—or dispersion—effective amount;

(c) Tetrapotassium ethylenediamine—tetraacetate (potassium EDTA) as a chelating agent, said potassium EDTA present in an amount effective to enhance soil, especially soap scum, removal in said cleaner; and (d) the remainder, water.

Additional adjuncts in small amounts such as buffers, fragrance, dye and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the composition.

1. Solvents

The solvent is a water soluble or dispersible organic solvent having a vapor pressure of at least 0.001 mm Hg at 25° C. It is preferably selected from $C_{1-6}$ alkanol, $C_{1-6}$ diol, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as methylene, ethylene, propylene and butylene glycols, and mixtures thereof.

It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, diethylene glycol n-butyl ether, dipropylene glycol methyl ether, and mixtures them of. Preferred glycol ethers are ethylene glycol monobutyl ether, also known as butoxyethanol, sold as butyl Cellosolve by Union Carbide, and also sold by Dow Chemical Co., 2-(2-butoxyethoxy) ethanol, sold as butyl Carbitol, also by Union Carbide, and propylene glycol n-propyl ether, available from a variety of sources. Another preferred alkylene glycol ether is propylene glycol, t-butyl ether, which is commercially sold as Arcosolve PTB, by Arco Chemical Co. The n-butyl ether of propylene glycol is also preferred. Other suppliers of preferred solvents include Union Carbide. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%. These amounts of solvents are generally referred to as dispersion-effective or solubilizing effective amounts, since the other components, such as surfactants, are materials which are assisted into solution by the solvents. The solvents are also important as cleaning materials on their own, helping to loosen and solubilize greasy soils for easy removal from the surface cleaned.

2. Surfactants

The surfactant is an anionic, nonionic, amphoteric surfactant, or mixtures thereof. Optionally, a quaternary ammonium surfactant can be added.

a. Anionic, Nonionic and Amphoteric Surfactants

The anionic surfactant is, for example, a linear or branched $C_{6-14}$ alkylbenzene sulfonate, alkane sulfonate, alkyl sulfate, or generally, a sulfated or sulfonated $C_{6-14}$ surfactant. Witconate NAS, for example, is a 1-octanesufonate, from Witco Chemical Company. Pilot L-45, a $C_{11.5}$ alkylbenzene sulfonate (which are referred to as "LAS"), from Pilot Chemical Co., Biosoft S100 and S130 (non-neutralized linear alkylbenzene sulfonic acid, which is referred to as "HLAS") and S40 from Stepan Company; sodium dodecyl sulfate and sodium lauryl sulfate. The use of acidic surfactants having a higher actives level may be desirable due to cost-effectiveness.

The nonionic surfactants are selected from alkoxylated alcohols, alkoxylated phenol ethers, and other surfactants often referred to as semi-polar nonionics, such as the trialkyl amine oxides. The alkoxylated phenol ethers include octyl- and nonylphenol ethers, with varying degrees of alkoxylation., such as 1–10 moles of ethylene oxide per mole of phenol. The alkyl group can vary from $C_{6-16}$, although octyl- and nonyl chain lengths are readily available. Various suitable products available from Rohm and Haas under the trademark Triton, such as Triton N-57, N-101, N-111, X-45, X-100, X-102, and from Mazer Chemicals under the trademark Macol, from GAF Corporation under the trademark Igepal, from Texaco Chemical Company under the trademark Surfonic. The alkoxylated alcohols include ethoxylated, and ethoxylated and propoxylated $C_{6-16}$ alcohols, with about 2–10 moles of ethylene oxide, or 1–10 and 1–10 moles of ethylene and propylene oxide per mole of alcohol, respectively. Exemplary surfactants are available from Shell Chemical under the trademarks Neodol and Alfonic; and Huntsman. The semi-polar amine oxides are also preferred, although, for the invention, a mixture of nonionic and amine oxide surfactants can also be used. The amine oxides, referred to as mono-long chain, di-short chain, trialkyl amine oxides, have the general configuration:

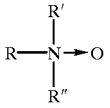

wherein R is $C_{6-24}$ alkyl, and R' and R" are both $C_{1-4}$ alkyl, or $C_{1-4}$ hydroxyalkyl, although R' and R" do not have to be equal. These amine oxides can also be ethoxylated or propoxylated. The preferred amine oxide is lauryl amine oxide. The commercial sources for such amine oxides are Barlox 10, 12, 14 and 16 from Lonza Chemical Company, Varox by Witco and Ammonyx by Stepan Co.

A further preferred semi-polar nonionic surfactant is alkylamidoalkylenedialkylamine oxide. Its structure is shown below:

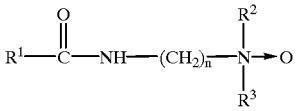

wherein $R^1$ is $C_{5-20}$ alkyl, $R^2$ and $R^3$ are $C_{1-4}$ alkyl,

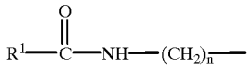

or $—(CH_2)_p—OH$, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole).

This surfactant is available from various sources, including from Lonza Chemical Company, as a cocoamidopropyldimethyl amine oxide, sold under the brand name Barlox C.

Additionally semi-polar surfactants include phosphine oxides and sulfoxides.

The amphoteric surfactant is typically an alkylbetaine or a sulfobetaine. One group of preferred amphoterics are alkylamidoalkyldialkylbetaines. These have the structure:

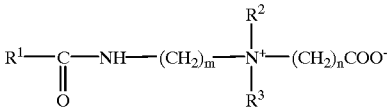

wherein $R^1$ is $C_{6-20}$ alkyl, $R^2$ and $R^3$ are both $C_{1-4}$ alkyl, although $R^2$ and $R^3$ do not have to be equal, and m can be 1–5, preferably 3, and n can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

The amounts of surfactants present are to be somewhat minimized, for purposes of cost-savings and to generally restrict the dissolved actives which could contribute to leaving behind residues when the cleaner is applied to a surface. However, the amounts added are generally about 0.001–10%, more preferably 0.002–3.00% surfactant. These are generally considered to be cleaning—effective amounts. On the other hand, if a dilutable concentrate is desired, the upper level of surfactant can be as high as 25%, more preferably around 15%. If a mixture of anionic and nonionic or amphoteric surfactants is used, the ratio of the anionic surfactant to the nonionic or amphoteric surfactant is about 20:1 to 1:20, more preferably about 10:1 to 1:10.

b. Quaternary Ammonium Surfactant

The invention may further optionally include a cationic surfactant, specifically, a quaternary ammonium surfactant. These types of surfactants are typically used in bathroom cleaners because they are generally considered "broad spectrum" antimicrobial compounds, having efficacy against both gram positive (e.g., Staphylococcus sp.) and gram negative (e.g., *Escherischia coli*) microorganisms. Thus, the quaternary ammonium surfactant, or compounds, are incorporated for bacteriostatic/disinfectant purposes and should be present in amounts effective for such purposes.

The quaternary ammonium compounds are selected from mono-long-chain, tri-short-chain, tetraalkyl ammonium compounds, di-long-chain, di-short-chain tetraalkyl ammonium compounds, trialkyl, mono-benzyl ammonium compounds, and mixtures thereof. By "long" chain is meant about $C_{6-30}$ alkyl. By "short" chain is meant $C_{1-5}$ alkyl, preferably $C_{1-3}$. Preferred materials include Stepan series, such as BTC 2125 series; Barquat and Bardac series, such as Bardac MB 2050, from Lonza Chemical. Typical amounts of the quaternary ammonium compound range from preferably about 0–5%, more preferably about 0.001–2%.

The tetrapotassium ethylene diamine tetraacetate (referred to as "potassium EDTA") is a critical part of the invention. Its use, in place of the standard chelating agent, tetrasodium EDTA, results in not only a surprisingly complete removal of various soils, including bathroom soap scum soils, but an unexpectedly rapid removal as well. The fact that the potassium salt of EDTA is so effective versus the tetrasodium salt was quite unawaited since, in other literature, the potassium salt has not been demonstrated to be a superior performer as compared to the tetrasodium salt. Additionally, in comparison to another favorable salt, tetraamonium EDTA, the inventive tetrapotassium EDTA has a distinct advantage in hiving low or no odor. This latter advantage is quite significant since the user of a cleaning product will not be favorably inclined to repeat usage of a product whose odor may not please her/him. Moreover, the tetrapotassium EDTA can be used as the sole chelating agents, or a discrete quantity of a co-chelant, such as tetrasodium EDTA may be added, in an amount ranging from about 1–5%.

The potassium EDTA can favorably be prepared by taking the acid form of EDTA and neutralizing it with KOH in a stoichiometric quantity. For example, to 50 g of the acid form of EDTA and 47 g deionized water, 76 g of KOH solution (45%) can be slowly added, resulting in a 46% $K_4EDTA$ solution. The acid form of EDTA can be obtained from Hampshire Chemicals and Aldrich Chemicals. In the neutralization of the acid form of EDTA, it is preferred to use an excess of alkali. Thus, for example, the level of KOH can vary from a stoichiometric quantity to from about a 0 to 5% excess.

The amount of potassium EDTA added should be in the range of 0.01–25%, more preferably 0.1–10%, by weight of the cleaner.

4. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is preferred.

Small amounts of adjuncts can be added for improving cleaning performance or aesthetic qualities of the cleaner. For example, buffers could be added to maintain constant pH (which for the invention is between about 7–14, more preferably between about 8–13). These buffers include NaOH, KOH, $Na_2CO_3$, $K_2CO_3$, as alkaline buffers, and phosphoric, hydrochloric, sulfuric acids as acidic buffers, and others. KOH is a preferred buffer since, in the invention, one way of obtaining potassium EDTA is to take the acidic EDTA acid and neutralize it with an appropriate, stoichiometric amount of KOH. Builders, such as phosphates, silicates, and again, carbonates, may be desirable. Further solubilizing materials, such as hydrotropes, e.g.s., cumene, toluene and xylene sulfonates, may also be desirable. Adjuncts for cleaning include additional surfactants, such as those described in *Kirk-Ohmer, Encyclopedia of Chemical Technology*, 3rd Ed., Volume 22, pp. 332–432 (Marcel-Dekker, 1983), and *McCutcheon's Soaps and Detergents* (N. Amer. 1984), which are incorporated herein by reference. Aesthetic adjuncts include fragrances, such as those available from Givaudan, IFF, Quest, Sozio, Firmenich, Dragoco and others, and dyes and pigments which can be solubilized or suspended in the formulation, such as diaminoanthraquinones. Water-insoluble solvents may sometimes be desirable as added grease or oily soil cutting agents. These types of solvents include tertiary alcohols, hydrocarbons (alkanes), pine-oil, d-limonene and other terpenes and terpene derivatives, and benzyl alcohols. Thickeners, such as calcium carbonate, sodium bicarbonate, aluminum oxide, and polymers, such as polyacrylate, starch, xanthan gum, alginates, guar gum, cellulose, and the like, may be desired additives. The use of some of these thickeners ($CaCO_3$ or $NaHCO_3$) is to be distinguished from their potential use as builders, generally by particle size or amount used. Anti-foaming agents, or foam controlling agents, may be also desirable, such as silicone defoamers. The amounts of these cleaning and aesthetic adjuncts should be in the range of 0–10%, more preferably 0–2%.

In the following Experimental section, the surprising performance benefits of the various aspects of the inventive cleaner are demonstrated.

EXPERIMENTAL

In the following Examples, soil removal performance of the inventive cleaners was conducted. Artificial soils were prepared in accordance with standards developed by the American Society for Testing and Materials ("ASTM") and modified by Applicants. The bathroom soil was prepared according to ASTM standard No. D5343-93 (incorporated herein by reference). Soap scum soil consisted of a layer of calcium stearate—to which a blue pigment was added—baked onto a ceramic tile.

In the following examples (I–VII), a further embodiment of this invention was prepared. In this embodiment, a dual chambered sprayer bottle was used, with one chamber containing a hydrogen peroxide solution (Example I), and the other, a mixture of a phase stable preparation of solvent, surfactants and various levels and types of EDTA (Examples II–VII). By separating the two solutions, the peroxide remains stable despite the high alkalinity of the overall composition.

EXAMPLE I

| $H_2O_2$ Solution | |
|---|---|
| Ingredients | Wt. % |
| $H_2O_2$ | 5% |
| D.I. Water | 95% |
| Total | 100% |

In the following Examples II–VII, unless otherwise indicated, the footnotes for each Example are the same and are not repeated for each such Example.

EXAMPLE II

| Ingredients | Wt. % |
|---|---|
| Solvent[1] | 9% |
| Anionic Surfactant[2] | 4% |
| Nonionic Surfactant[3] | 2% |
| Fragrance[4] | 0.65% |
| $Na_4EDTA$ | 0 |
| **$K_4EDTA$** | **5.4%** |
| NaOH | 0 |

EXAMPLE II-continued

| Ingredients | Wt. % |
|---|---|
| KOH | 0.5% |
| D.I. Water | q.s. |
| Total | 100% |

[1]Butyl Carbitol, Union Carbide
[2]1-Octane-Sulfonate
[3]$C_{10-12}$ linear alcohol with 6 moles of ethylene oxide
[4]International Flavors & Fragrances

EXAMPLE III

| Ingredients | Wt. % |
|---|---|
| Solvent[1] | 9% |
| Anionic Surfactant[2] | 4% |
| Nonionic Surfactant[3] | 2% |
| Fragrance[4] | 0.65% |
| $Na_4EDTA$ | 1.0% |
| **$K_4EDTA$** | **4.4%** |
| NaOH | 0.09% |
| KOH | 0.41% |
| D.I. Water | q.s. |
| Total | 100% |

EXAMPLE IV

| Ingredients | Wt. % |
|---|---|
| Solvent[1] | 9% |
| Anionic Surfactant[2] | 10% |
| Nonionic Surfactant[3] | 2% |
| Fragrance[4] | 0.65% |
| $Na_4EDTA$ | 2.0% |
| **$K_4EDTA$** | **3.4%** |
| NaOH | 0.19% |
| KOH | 0.31% |
| D.I. Water | q.s. |
| Total | 100% |

EXAMPLE V

| Ingredients | Wt. % |
|---|---|
| Solvent[1] | 9% |
| Anionic Surfactant[2] | 4% |
| Nonionic Surfactant[3] | 2% |
| Fragrance[4] | 0.65% |
| $Na_4EDTA$ | 3.0% |
| **$K_4EDTA$** | **2.4%** |
| NaOH | 0.28 |
| KOH | 0.22% |
| D.I. Water | q.s. |
| Total | 100% |

EXAMPLE VI

| Ingredients | Wt. % |
|---|---|
| Solvent[1] | 9% |
| Anionic Surfactant[2] | 4% |
| Nonionic Surfactant[3] | 2% |
| Fragrance[4] | 0.65% |
| $Na_4EDTA$ | 4.0% |
| **$K_4EDTA$** | **1.4%** |
| NaOH | 0.37% |
| KOH | 0.13% |
| D.I. Water | q.s. |
| Total | 100% |

EXAMPLE VII

Comparison Example

| Ingredients | Wt. % |
|---|---|
| Solvent[1] | 9% |
| Anionic Surfactant[2] | 4% |
| Nonionic Surfactant[3] | 2% |
| Fragrance[4] | 0.65% |
| $Na_4EDTA$ | 5.4% |
| **$K_4EDTA$** | **0** |
| NaOH | 0.5% |
| KOH | 0 |
| D.I. Water | q.s. |
| Total | 100% |

In this test, bathroom soil removal is measured using, as a testing apparatus, a Minolta proprietary device, which measures the integrated areas under a cleaning profile curve, which is the cumulative amount of soil removed at each cycle, with a maximum of 30 cycles. Thus, a maximum score of 3,000 can theoretically be achieved. In any case, in this test, the higher score achieved is more preferred. Five repetitions of each of the Formulations in Examples II–VII were tested. The results are tabulated below.

TABLE I

| Formulation | No. of Reps. | Avg. Score | Std. Dev. |
|---|---|---|---|
| Eg. II | 5 | 2,742 | 18.5 |
| Eg. III | 5 | 2,587 | 40.2 |
| Eg. IV | 5 | 2,539 | 44.2 |
| Eg. V | 5 | 2,375 | 42.2 |
| Eg. VI | 5 | 2,241 | 60.9 |
| Eg. VII (Comp.) | 5 | 1,700 | 176.5 |

As can be seen from the foregoing data, Example VII, the comparison example with only $Na_4$ EDTA, was greatly outperformed by the preceding Examples II–VI, which contained at least some $K_4$ EDTA. This superior performance was greatly unexpected.

A similar set of data is set forth in FIG. 1, which graphically portrays the soil removal performance of Examples II–VI and Comparison Example VII. Once again, it can be seen that the soil removal performance of II–VI is not only superior, but much faster than that of VII.

In the next experiment, the speed of the inventive formulation is compared against a comparison cleaner. For all subsequent formulations discussed, a single chamber package is intended to be utilized as a delivery means.

EXAMPLE VIII

Speed of Soil Removal Performance

| Formula VIIIA (Invention) | | Formula VIIIB (Comparison) | |
|---|---|---|---|
| Ingredients | Wt. % | Ingredients | Wt. % |
| $K_2CO_3$ | — | $K_2CO_3$ | 0.1 |
| $Na_4EDTA$ | — | $Na_4$ EDTA | 5.45 |
| $K_4EDTA$ | 5.4 | $K_4$ EDTA | — |
| Butyl Carbitol | 4.5 | Butyl Carbitol | 4.5 |
| Quat. Am[1] | — | Quat. Am[1] | 0.27 |
| Nonionic[2] | 1.0 | Nonionic[3] | 2.25 |

EXAMPLE VIII-continued

Speed of Soil Removal Performance

| Formula VIIIA (Invention) | | Formula VIIIB (Comparison) | |
|---|---|---|---|
| Ingredients | Wt. % | Ingredients | Wt. % |
| Fragrance | — | Fragrance | 0.25 |
| Water | bal. to 100% | Water | bal to 100% |

[1]quaternary ammonium compound, di-long chain, di-short chain tetraalkyl ammonium chloride, Stepan Co.
[2]$C_{10-12}$ linear alcohol ethoxylate, 6 moles of ethylene oxide, Huntsman Chemical
[3]octylphenol ethoxylate, 10 moles of ethylene oxide, Rohm & Haas The above two formulations were then subjected to the drop test, in which a very small, discrete amount of cleaner is dropped, by pipette, onto white tiles which have been uniformly coated with a thin layer of bathroom soil. The tiles are then visually graded by a panel of graders on a 0 to 100% scale, where 0=no cleaning, 100%=complete cleaning. The results are disclosed below:

TABLE II

Drop Test

| Formulation | 30 seconds | 20 seconds | 10 seconds |
|---|---|---|---|
| VIIIA | 100% | 100% | 100% |
| VIIIB (Comparison) | 0 | 0 | 0 |

As can be seen from the foregoing data, the inventive formulation, containing potassium EDTA, outperforms a somewhat comparable Comparison formulation which uses sodium EDTA.

In the experiment below, a comparison of soil removal performance between sodium EDTA, potassium EDTA and ammonium EDTA (subject of the co-pending patent application of Mills et al., U.S. Ser. No. 08/632,041, now U.S. Patent No. 5,814,591 filed Apr. 12, 1996) was conducted. The Formulations are designated as Examples IXA, IXB (invention) and IXC, and are set forth below:

TABLE III

| | Examples | | |
|---|---|---|---|
| Ingredients | IXA | IXB (invention) | IXC |
| Solvent[1] | 5.4% | 5.4% | 5.4% |
| Surfactant[2,3] | 1% | 1% | 2.25% |
| $Na_4EDTA$ | 5.4% | — | — |
| $K_4EDTA$ | — | 5.4% | — |
| $(NH_4)_4EDTA$ | — | — | 5.4% |
| D.I. Water | q.s. | q.s. | q.s. |

[1]Butyl Carbitol
[2]For IXA and IXB, $C_{10-12}$ alcohol ethoxylate, 6 moles of ethylene oxide, Huntsman.
[3]For IXC, ethoxylated octylphenol ether, 10 moles of ethylene oxide, Rohm & Haas As previously described, in this test, soap scum removal is measured using, as a testing apparatus, a Minolta proprietary device, which measures the integrated areas under a cleaning profile curve, which is the cumulative amount of soil removed at each cycle, with a maximum of 30 cycles. Thus, a maximum score of 3,000 can theoretically be achieved. In any case, in this test, the higher score achieved is more preferred. Three repetitions of each of the Formulations were tested. The results are tabulated below in

TABLE IV.

TABLE IV

| Formulation | No. of Reps. | Avg. Score | Std. Dev. |
|---|---|---|---|
| IXA | 3 | 1,170 | 70.6 |
| IXB (invention) | 3 | 1,484 | 121.7 |
| IXC | 3 | 1,763 | 115.7 |

Figure 2:
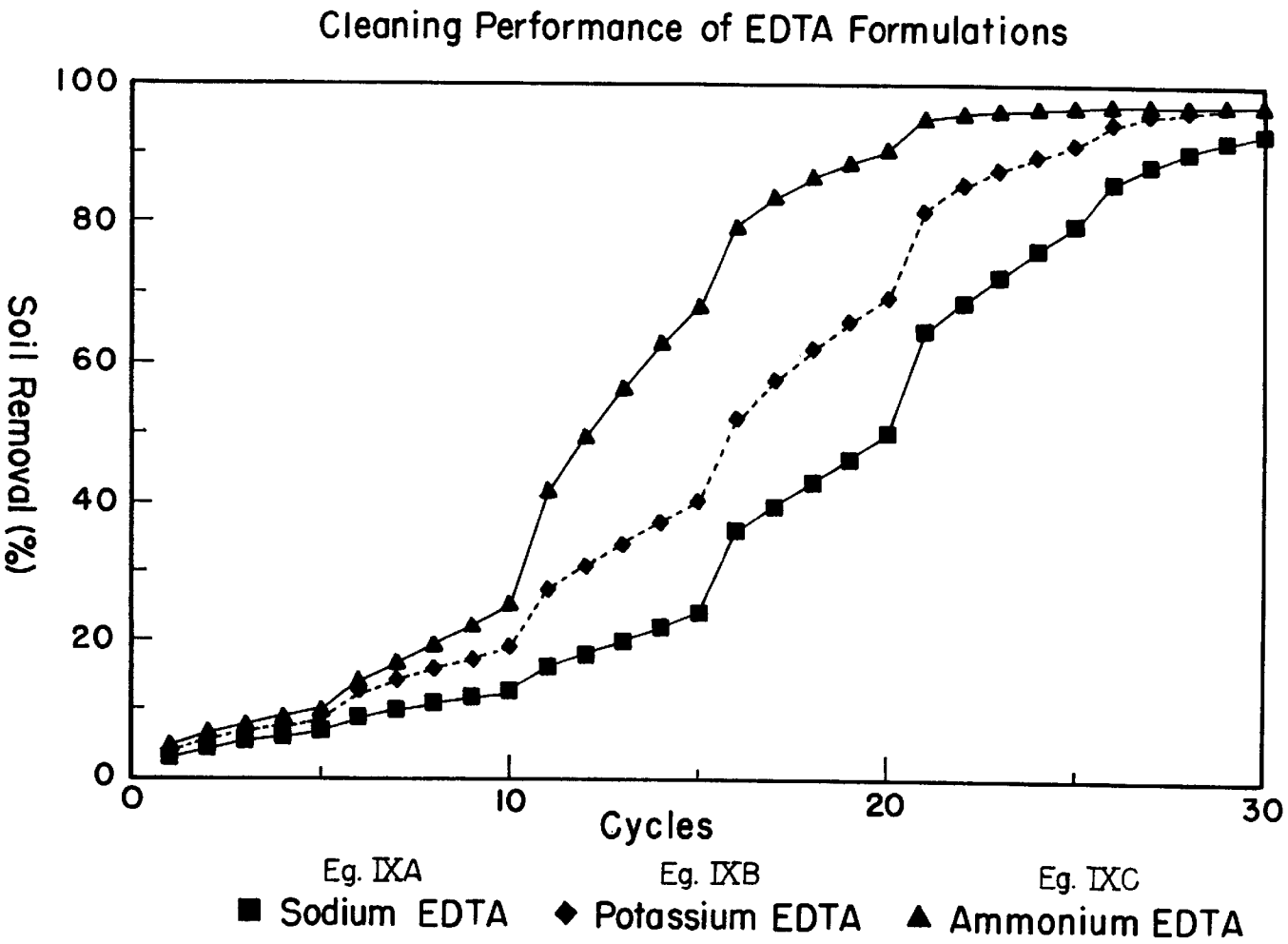

As can be seen from the data, the invention clearly outscores the comparison example IXA and is not quite as effective as comparison Example IXC. This is also graphically depicted in FIG. 2.

In the following Example X, the excellent performance of the inventive cleaner in an odor comparison is set forth. Each of the formulations XA and XB were prepared, XA being the invention with $K_4$EDTA, XB being a comparison with $(NH_4)_4$EDTA. 10 ml of each formulation was placed in a 250 ml beaker, and an expert grading panel was utilized to evaluate the irritancy and base odor intensity of each formulation. In general, a lower score in each category was desirable.

EXAMPLE X

Odor Comparison

| Formulation XA (Invention) | | Formulation XB (Comparison) | |
|---|---|---|---|
| Ingredients | Wt. % | Ingredients | Wt. % |
| $K_4$EDTA | 5.4 | $K_4$EDTA | — |
| $(NH_4)_4$EDTA | — | $(NH_4)_4$EDTA | 5.4 |
| Butyl Carbitol | 4.5 | Butyl Carbitol | 4.5 |
| Nonionic[1] | 1.0 | Nonionic[1] | 1.0 |
| Water | bal. to 100% | Water | bal. to 100% |

[1]$C_{10-12}$ alcohol ethoxylate, 6 moles of ethylene oxide, Huntsman.

The odor tests are set forth below in TABLE V:

TABLE V

| Formulation | Irritancy (10 = very irritating) | Base Odor (10 = very strong) |
|---|---|---|
| XA (Invention) | 2.1 | 4.8 |
| XB (Comparison) | 9.6 | 9.8 |

It is readily apparent that the inventive formulations have superior odor characteristics.

In the next set of Examples, a different base formulation is used. This is set forth in Example XI. It should be noted that Example XI, and thus, the remaining Examples which base their formulations on Example XI, are intended to be used as bathroom cleaners without a co-dispensing oxidant solution, unlike some of the preceding Examples.

EXAMPLE XI

Alternate Base Formulation

| Ingredients | Wt. % |
|---|---|
| Solvent[1] | 4.5% |
| Nonionic Surfactant[2] | 0.9% |
| Quaternary Ammonium Surfactant[3] | 1.0% |
| Fragrance[4] | 0.2% |
| EDTA | 5.4% |
| Free Hydroxide | 0–3% |

EXAMPLE XI-continued

Alternate Base Formulation

| Ingredients | Wt. % |
|---|---|
| D.I. Water | q.s. |
| Total | 100% |

[1]Butyl Carbitol, Union Carbide.
[2]$C_{12}$ monoalkyl, dimethyl amine oxide, Lonza.
[3]$C_{24}$ Alkylbenzyl dimethyl ammonium chloride, Stepan Company.
[4]Proprietary fragrance (Firmenich)

EXAMPLE XII

Bathroom Soil % Removal

Figure 3:
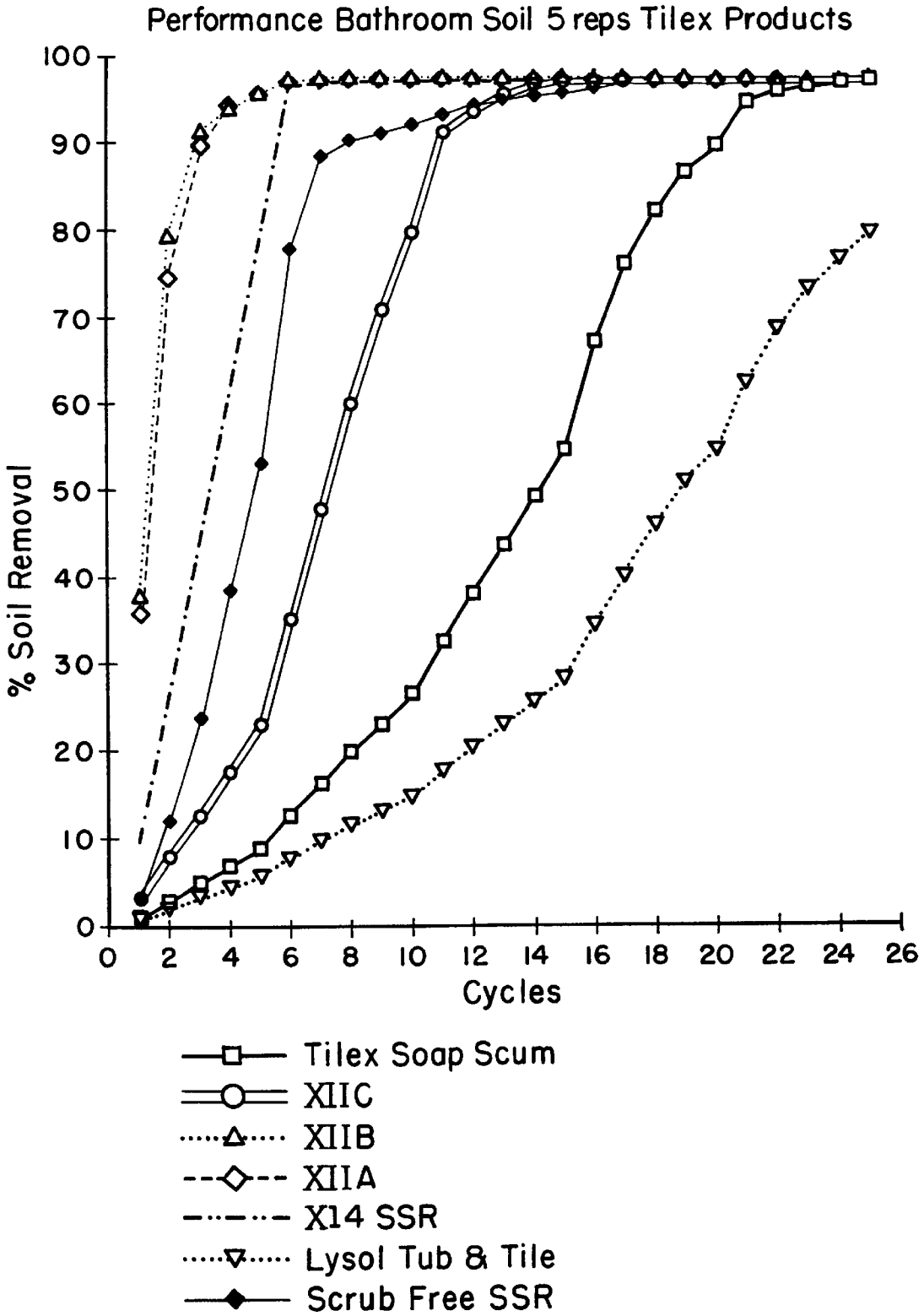

In this example, a screening study of the inventive cleaner XIIA (Example XI's formulation, with $K_4$ EDTA), was compared against not only the Comparison Examples XIIB (with $Na_4$ EDTA) and XIIC (with $(NH_4)_4$ EDTA), but as against four different commercially available bathroom cleaners. The commercial cleaners are: Tilex Soap Scum Remover (Clorox Co.), Scrub Free Soap Scum Remover (Benckhiser), Lysol Basin Tub and Tile Cleaner (Reckitt and Colman), and X-14 Soap Scum Remover (Block Drug). None of the four commercial cleaners contain potassium EDTA. And, the Scrub Free Soap Scum Again, the proprietary Minolta device is used to measure bathroom soil removal. The amount of soil removed was measured in 25 cycles, with 5 repetitions of each cleaner conducted. The data thus gathered was also plotted on a graph (FIG. 3) in which the y axis is % soil removed, the x axis is the number of cycles. The data was gathered below, In TABLE VI:

TABLE VI

| Formulation | No. of Reps. | Avg. Score | Std. Dev. |
|---|---|---|---|
| **XIIA (invention)** | **5** | **2,270** | **13.9** |
| XIIB ($(NH_4)_4$EDTA) | 5 | 2,282 | 21.7 |
| XIIC ($Na_4$EDTA) | 5 | 1,753 | 119.1 |
| Tilex SSR | 5 | 1,175 | 116.3 |
| Scrub Free SSR | 5 | 1,965 | 87.3 |
| Lysol Basin, T&T | 5 | 732 | 155.1 |
| X-14 SSR | 5 | 2,099 | 15.3 |

These data show conclusively that the inventive formulation outperformed most of the other formulations, with the exception of the formulation of XIIB (again, the subject of co-pending application Ser. No. 08/632,041, of common assignment).

The next six Examples demonstrate that the speed of the inventive formulations' cleaning efficacy is maintained at various levels of $K_4$EDTA. The levels of $K_4$EDTA in the base formulation of Example XI varied from 2.5% (Example XIII) to 5.4% (Example XVIII). These Examples were compared against a Comparison Example (Example XIX). (Generally speaking, the formulations with varying levels of $K_4$EDTA were adjusted in the amount of water in the formulations; however, in these data, the buffering material, KOH, was not added to a stoichiometric excess.) The test was the drop test previously discussed above in Example VIII above. The substrates used were white tiles which soiled with bathroom soil. Three tiles were cleaned with the score based on an averaged score by 7 expert panelists. The visual grades were scored on a 1 to 10 scale, wherein 1=no soil removal, while 10=complete soil removal. The results are tabulated below in Table VII:

TABLE VII

| Formulation | Drop Test 30 seconds | 60 seconds | 90 seconds |
|---|---|---|---|
| XIII (2.5%) | 9.83 | 10 | 10 |
| XIV (3%) | 9.83 | 10 | 10 |
| XV (3.5%) | 9.78 | 9.83 | 9.78 |
| XVI (4%) | 10 | 10 | 10 |
| XVII (4.25%) | 9.94 | 10 | 9.28 |
| XVIII (5.4%) | 10 | 10 | 10 |
| XIX (Comp.) | 0.83 | 0.83 | 0.83 |

Figure 4:
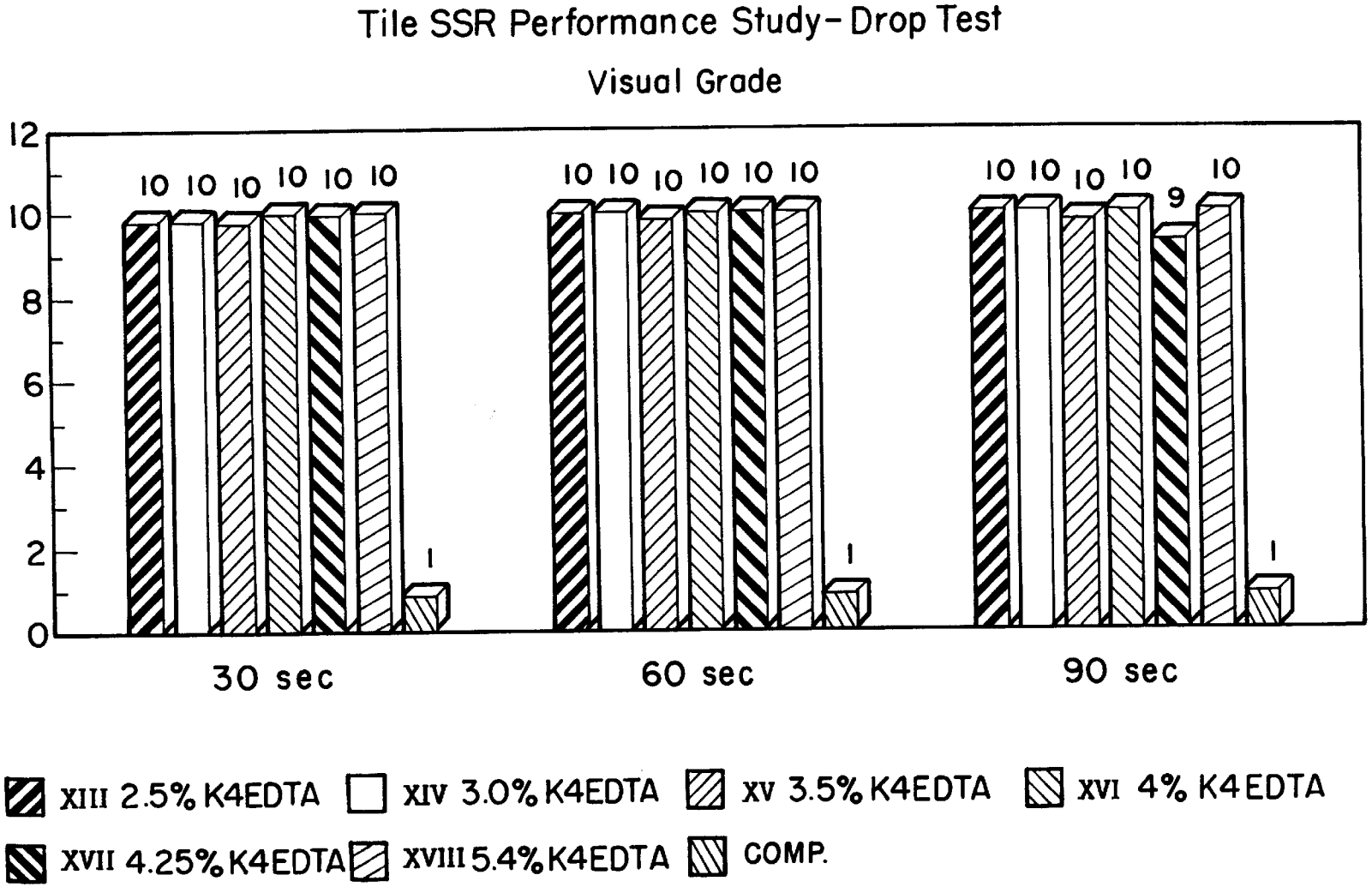

These data thus demonstrate the unexpected speed and cleaning efficacy of the inventive compositions, at a wide range of $K_4$EDTA levels. These data are also graphically portrayed in FIG. 4, as a block diagram.

In the next set of data, performance testing was conducted comparing three versions of the inventive cleaner (one with 5.4% $K_4$EDTA, Example XX, the other with 5% $K_4$EDTA, Example XXI—different fragrances and 0.05% levels of excess KOH were used in the two embodiments; and another 5.4% $K_4$EDTA formulation without excess KOH, Example XXVII) versus formulations containing $(NH4)_4$EDTA and $Na_4$EDTA, respectively, and a commercial cleaner (Lysol Basin, Tub & Tile), on soap scum. This artificial soil, prepared as previously described, is applied on white, porcelain tiles. The reason for adding this pigment is quite practical: the Minolta proprietary device (which is a calorimetric detector) has difficulty reading the soap scum stain against the background of the white tile. Thus, addition of the pigment establishes a detectable background for the device. The results are set forth in TABLE VIII below:

TABLE VIII

| Formulation | Blue Soap Scum Soil Removal No. of Reps. | Avg. Score | Std. Dev. |
|---|---|---|---|
| **XX (5.4% $K_4$EDTA)** | **5** | **2,034** | **50.6** |
| **XXI (5% $K_4$EDTA)** | **5** | **1,982** | **105.4** |
| **XXII (Tilex SSR/$K_4$EDTA)** | **5** | **2,033** | **90.9** |
| Tilex SSR/$(NH_4)_4$EDTA | 5 | 1,750 | 79.4 |
| Tilex SSR | 5 | 1,711 | 98.9 |
| Lysol Basin/Tub/Tile | 5 | 1,483 | 108 |

Figure 5:
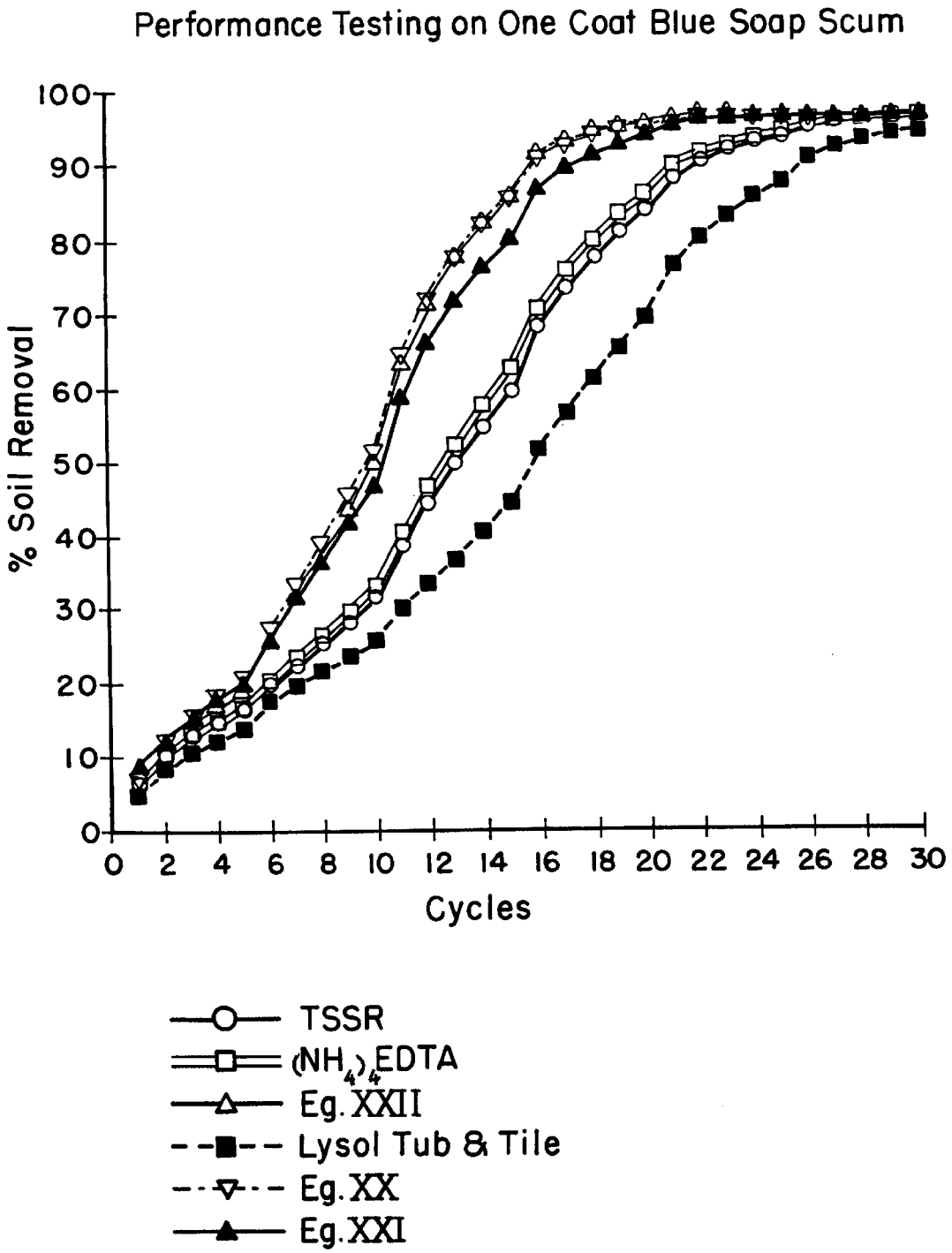

This data demonstrates that the three inventive formulations outperformed the comparison examples. The results of these data are also graphically portrayed in FIG. 5 wherein % soil removal is plotted as the Y-axis and cycles (strokes to remove) are plotted as the X-axis.

The invention is further defined and delineated by the claims which follow hereto.

What is claimed is:

1. An aqueous hard surface cleaner with improved and rapid soil removal comprising:

(a) a surfactant selected from the group consisting of anionic, nonionic surfactants, and mixtures thereof, with optionally, a quaternary ammonium surfactant the total amount of surfactant being present from about 0.001–10% by weight;

(b) at least one water-soluble or dispersible organic solvent having a vapor pressure of at least 0.001 mm Hg at 25° C., said at least one organic solvent being selected from the group consisting of alkanols, diols, glycol ethers, and mixtures thereof present from about 1% to to 50% by weight of the cleaner;

(c) Tetrapotassium ethylenediamine—tetraacetate (potassium, EDTA) as a chelating agent, said potassium EDTA present from about 0.01–25% weight of said cleaner; and (d) optionally dipotassiun carbonate as a buffer; and (e) the remainder, water.

2. The cleaner of claim 1 which comprises a single phase, isotropic solution.

3. The cleaner of claim 1 wherein said surfactant is an anionic surfactant of (a), selected from the group consisting of a linear or branched $C_{6-4}$ alkylbenzene sulfonate, alkane sulfonate, alkyl sulfate, and mixtures thereof.

4. The cleaner of claim 1 wherein said surfactant of (a) is a nonionic surfactant, selected from the group consisting of an alkoxylated alkylphenol ether, an alkoxylated alcohol, or a semi-polar nonionic surfactant.

5. The cleaner of claim 4 wherein said nonionic surfactant is a semi-polar nonionic surfactant selected from the group consisting of mono-long-chain alkyl, di-short-chain trialkyl amine oxides, alkylamidodialkyl amine oxides, phosphine oxides and sulfoxides.

6. The cleaner of claim 5 wherein said nonionic surface of (a) is a mono-long-chain, di-short-chain trialkyl amine oxide.

7. The cleaner of claim 4 wherein said nonionic surfactant is an ethoxylated alkylphenol ether selected from the group consisting of ethoxylated octylphenol ethers, ethoxylated nonylphenol ethers, and mixtures thereof.

8. The cleaner of claim 7 wherein said nonionic surfactant is an ethoxylated octylphenol, ethoxylated with 1–10 moles of ethylene oxide.

9. The cleaner of claim 1 wherein said organic solvent is a $C_{3-24}$ glycol ether.

10. The cleaner of claim 1 further comprising (f) a quaternary ammonium compound.

11. The cleaner of claim 10 wherein said quaternary ammonium compound is selected from the group consisting of mono-long-chain, ti-short-chain, tetraalkyl ammonium compounds, di-long-chain, di-short-chain tetra-alkyl ammonium compounds, trialkyl, mono-benzyl ammonium compounds, and mixtures thereof.

12. The cleaner of claim 1 further comprising (g) at least one adjunct selected from the group consisting of builders, buffers, fragrances, thickeners, dyes, pigments, foaming stabilizers, water-insoluble organic solvents, and hydrotropes.

13. The cleaner of claim 1 wherein said tetrapotassium EDTA is prepared by neutralizing the acid form of EDTA.

14. The cleaner of claim 13 wherein the neutralizing agent is potassium hydroxide.

15. The cleaner of claim 13 wherein said potassium hydroxide is present in a stoichiometric to slightly greater than stoichiometric amount.

16. The cleaner of claim 1 further comprising tetrasodium EDTA as a co-chelant.

* * * * *